US012709441B1

(12) United States Patent
Corwin et al.

(10) Patent No.: US 12,709,441 B1
(45) Date of Patent: Aug. 18, 2026

(54) BOTTLE HAVING DUAL-SEAL CLOSURE

(71) Applicant: BeautyAvenues, LLC, Reynoldsburg, OH (US)

(72) Inventors: Jeff Corwin, Columbus, OH (US); Elizabeth Bogert, New Albany, OH (US); Susan Grohman, Delaware, OH (US); Jason Nethers, Newark, OH (US); Travis White, Hebron, OH (US); Michael Altomonte, Granville, OH (US); Richard Lavigne, Basalt, CO (US); Ivan Da Barp, Westerville, OH (US)

(73) Assignee: BeautyAvenues, LLC, Reynoldsburg, OH (US)

( * ) Notice: Subject to any disclaimer, the term of this patent is extended or adjusted under 35 U.S.C. 154(b) by 182 days.

(21) Appl. No.: 18/612,273

(22) Filed: Mar. 21, 2024

Related U.S. Application Data

(60) Provisional application No. 63/491,941, filed on Mar. 23, 2023.

(51) Int. Cl.
*B65D 41/04* (2006.01)
*B65D 47/12* (2006.01)

(52) U.S. Cl.
CPC ..... *B65D 41/0414* (2013.01); *B65D 47/123* (2013.01)

(58) Field of Classification Search
CPC .... B65D 47/40; B65D 83/40; B65D 2255/20; B65D 41/0414; B65D 47/123; B05B 11/0013
See application file for complete search history.

(56) References Cited

U.S. PATENT DOCUMENTS 4,464,316 A 8/1984 Michaels
4,821,899 A * 4/1989 Nycz ..... B65D 47/0895 220/834

(Continued)

FOREIGN PATENT DOCUMENTS

AT 16451 U1 10/2019
CN 108966644 A 12/2018

(Continued)

OTHER PUBLICATIONS

"Flasche Brid Flashland Rally Bottle Bird 520ml Amber 'Set of 3'", admitted prior art, accessed Jan. 28, 2023, available at https://en.ruten.co.jp/prod/1119659845.

(Continued)

*Primary Examiner* — Donnell A Long
(74) *Attorney, Agent, or Firm* — Andrus Intellectual Property Law, LLP

(57) ABSTRACT

Disclosed is an assembly for holding and dispensing a flowable consumer product, wherein the assembly comprises a bottle and a cover assembly, wherein the bottle and the cover assembly are configured to be threadedly engaged in a manner such that rotation of the cover assembly with respect to the bottle is permitted in a first direction and restricted in an opposite, second direction and wherein the cover assembly includes a first seal which is configured to be engaged with an inner surface of the bottle and wherein the cover assembly includes a second seal having a downward projection which engages with an upper surface of the bottle.

15 Claims, 14 Drawing Sheets

(56) References Cited

U.S. PATENT DOCUMENTS

| | | | | |
|---|---|---|---|---|
| 5,058,772 | A * | 10/1991 | Moore | B65D 47/40 222/571 |
| 5,101,993 | A * | 4/1992 | Nairn | B65D 47/123 215/232 |
| 5,251,788 | A * | 10/1993 | Moore | B65D 47/123 222/111 |
| 5,489,036 | A | 2/1996 | Arkins | |
| 5,687,863 | A | 11/1997 | Kusz | |
| 5,803,287 | A | 9/1998 | Kusz | |
| 5,915,576 | A | 6/1999 | Robinson | |
| D609,571 | S | 2/2010 | Butler | |
| 7,901,152 | B2 | 3/2011 | Hines | |
| 7,958,703 | B2 | 6/2011 | Miota | |
| 8,333,289 | B2 | 12/2012 | Lopez | |
| D673,452 | S | 1/2013 | Handy | |
| 8,474,657 | B2 * | 7/2013 | Szekely | B65D 47/40 222/111 |
| 8,479,952 | B2 * | 7/2013 | Tauber | B65D 47/122 222/111 |
| D702,131 | S | 4/2014 | Handy | |
| D704,069 | S | 5/2014 | Handy | |
| D712,267 | S | 9/2014 | Handy | |
| D720,618 | S | 1/2015 | Handy | |
| 9,174,778 | B2 | 11/2015 | Toh | |
| D787,941 | S | 5/2017 | Bos | |
| D801,179 | S | 10/2017 | Mcgreevy | |
| 10,086,980 | B2 | 10/2018 | Isogai | |
| 10,138,041 | B2 | 11/2018 | Lopez | |
| 10,737,859 | B2 | 8/2020 | Lopez | |
| 11,518,579 | B2 | 12/2022 | Azelton | |
| 11,524,821 | B2 * | 12/2022 | Jelich | B65D 51/18 |
| 11,554,899 | B2 | 1/2023 | Sterling | |
| 12,151,053 | B2 | 11/2024 | Pieper | |
| 2004/0011812 | A1 * | 1/2004 | Kasting | B65D 25/32 222/569 |
| 2006/0102662 | A1 * | 5/2006 | Rohr | B65D 25/42 222/570 |
| 2008/0164282 | A1 * | 7/2008 | Szekely | B65D 47/40 222/111 |
| 2009/0078786 | A1 | 3/2009 | Slade | |
| 2015/0048113 | A1 * | 2/2015 | Brannon | B65D 50/046 222/109 |
| 2019/0071225 | A1 | 3/2019 | Bertram | |
| 2023/0002114 | A1 | 1/2023 | Sterling | |
| 2023/0020831 | A1 | 1/2023 | Sterling | |

FOREIGN PATENT DOCUMENTS

| | | | |
|---|---|---|---|
| CN | 213650520 | U | 7/2021 |
| CN | 214397730 | U | 10/2021 |
| DE | 102006006771 | B3 | 4/2007 |
| EM | 002016899-0001 | | 10/2012 |
| EM | 002016899-0002 | | 10/2012 |
| EM | 002016899-0003 | | 10/2012 |
| TN | SN06120 | A1 | 4/2006 |
| TW | I436928 | B | 5/2014 |
| WO | 2023183837 | A2 | 9/2023 |

OTHER PUBLICATIONS

Lavigne, Richard, "Bottle", Design U.S. Appl. No. 29/876,853, filed May 30, 2023 (specification and drawings only).

* cited by examiner

BOTTLE HAVING DUAL-SEAL CLOSURE

CROSS-REFERENCE TO RELATED APPLICATION

The present application claims the benefit of U.S. Provisional Application No. 63/491,941, filed Mar. 23, 2023, which is hereby incorporated by reference herein.

FIELD

The present disclosure relates to a bottle and a cover assembly, wherein the cover assembly includes seals for preventing leakage of flowable consumer products.

BACKGROUND

When flowable consumer products, especially liquids, are shipped to consumers in bottles, there is a risk they will open during shipping and leak. Some manufacturers provide shrink wrap over the cap and bottle neck to prevent leakage during shipping. When a product is not shrink-wrapped, some retailers tape the cap to the bottle in order to prevent leakage. Other retailers place the entire bottle into a separate plastic bag, which is either taped or zip-tied, to contain leaks in the event they occur. All of these efforts add cost, time, and complexity to the shipping process, as well as create unnecessary waste. Moreover, these known solutions are barriers to consumers being able to easily access and observe one or more qualities, such as the fragrance of, the consumer product housed therein.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter.

According to one example of the present disclosure, an assembly for holding and dispensing a flowable consumer product comprises a bottle and a cover assembly. The bottle and the cover assembly are configured to be threadedly engaged in a manner such that rotation of the cover assembly with respect to the bottle is permitted in a first direction and restricted in an opposite, second direction. The cover assembly includes a first seal that is configured to engage with an inner surface of the bottle. The cover assembly also includes a second seal having a downward projection that is configured to engage with an upper surface of the bottle.

In non-limiting examples disclosed herein, the cover assembly includes a spout which is configured to threadedly engage with the bottle and a cap which is configured to threadedly engage with the spout.

In non-limiting examples disclosed herein, the spout is configured to be threadedly engaged with the bottle in a manner such that rotation of the spout with respect to the bottle is permitted in the first direction and restricted in the opposite, second direction.

In non-limiting examples disclosed herein, the bottle includes a lug and the spout includes a tooth. The lug and the tooth are configured to be engaged to prevent rotation of the spout relative to the bottle in the second direction.

In non-limiting examples disclosed herein, the lug has a lower first end that slopes upwardly toward a higher second end, and the tooth is configured to ride over the lug from the first end to the second end thereof as the spout is threaded onto the bottle in the first direction.

In non-limiting examples disclosed herein, the lug has a lower first end that slopes upwardly toward a higher second end, and rotation of the spout relative to the bottle in the second direction is prevented by way of the tooth engaging with the second end of the lug.

In non-limiting examples disclosed herein, the spout includes a first skirt and a second skirt surrounding the first skirt. The tooth extends downwardly from a lower edge of the first skirt.

In non-limiting examples disclosed herein, the first and second skirts and the tooth are dimensioned such that the tooth does not extend below a lower edge of the second skirt.

In non-limiting examples disclosed herein, the first seal is a plug seal.

In non-limiting examples disclosed herein, the second seal is a V-shaped seal.

In non-limiting examples disclosed herein, the first seal is a plug seal, the second seal is a V-shaped seal, and the first seal is positioned adjacent to the second seal.

In non-limiting examples disclosed herein, the first seal is located radially inwardly of the second seal.

According to another example of the present disclosure, an assembly for holding and dispensing a flowable consumer product comprises a bottle having a neck, a spout configured to be attached to the neck, and a cap configured to be attached over a dispensing end of the spout. The spout includes a plug seal and a V-shaped seal that are configured to be engaged with the neck of the bottle. The spout is configured to be threadedly engaged with the bottle in a manner such that rotation of the spout with respect to the bottle is permitted in a first direction and restricted in an opposite, second direction. The cap is configured to be threadedly engaged with the spout.

In non-limiting examples disclosed herein, the V-shaped seal is a downward projection that extends from a lower inner surface of the spout and frictionally engages with an upper surface of the neck of the bottle.

In non-limiting examples disclosed herein, the plug seal is a downwardly elongated protrusion having an outer surface that is configured to frictionally engage an inner surface of the neck of the bottle.

In non-limiting examples disclosed herein, the plug seal includes a beveled end that is configured to engage the neck of the bottle and guide the plug seal into frictional engagement with the bottle.

In non-limiting examples disclosed herein, the bottle includes a lug and the spout includes a tooth, and the lug and the tooth are configured to be engaged to prevent rotation of the spout relative to the bottle in the second direction.

In non-limiting examples disclosed herein, the lug has a lower first end that slopes upwardly toward a higher second end, and the tooth is configured to ride over the lug from the first end to the second end thereof as the spout is threaded onto the bottle in the first direction.

In non-limiting examples disclosed herein, the lug has a lower first end that slopes upwardly toward a higher second end, and rotation of the spout relative to the bottle in the second direction is prevented by way of the tooth engaging with the second end of the lug.

In non-limiting examples disclosed herein, the spout includes a first skirt and a second skirt surrounding the first skirt. The tooth extends downwardly from a lower edge of the first skirt. The first and second skirts and the tooth are dimensioned such that the tooth does not extend below a lower edge of the second skirt.

In non-limiting examples disclosed herein, an assembly for holding and dispensing a flowable consumer product comprising a combination of the features previously discussed holds a liquid laundry detergent. In other non-limiting examples disclosed herein, an assembly for holding and dispensing a flowable consumer product comprising a combination of the features previously discussed holds a granulated laundry product.

BRIEF DESCRIPTION OF THE DRAWINGS

The present disclosure is described with reference to the following Figures. The same numbers are used throughout the Figures to reference like features and like components.

DETAILED DESCRIPTION OF THE DRAWINGS

Before any embodiments of the invention are explained in detail, it is to be understood that, unless specifically stated otherwise herein, the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Unless otherwise specified or limited, the phrases "at least one of A, B, and C," "one or more of A, B, and C," and the like, are meant to indicate A, or B, or C, or any combination of A, B, and/or C, including combinations with multiple instances of A, B, and/or C. Likewise, unless otherwise specified or limited, the terms "mounted," "connected," "linked," "supported," and "coupled" and variations thereof are used broadly and encompass both direct and indirect mountings, connections, supports, and couplings. Further, unless otherwise specified or limited, "connected" and "coupled" are not restricted to physical or mechanical connections or couplings.

As used herein, unless otherwise limited or defined, discussion of particular directions is provided by example only, with regard to particular embodiments or relevant illustrations. For example, discussion of "top," "bottom," "front," "back," "left," "right," "lateral" or "longitudinal" features is generally intended as a description only of the orientation of such features relative to a reference frame of a particular example or illustration. Correspondingly, for example, a "top" feature may sometimes be disposed below a "bottom" feature (and so on), in some arrangements or embodiments. Additionally, use of the words "first," "second", "third," etc. is not intended to connote priority or importance, but merely to distinguish one of several similar elements from another.

Figure 1:
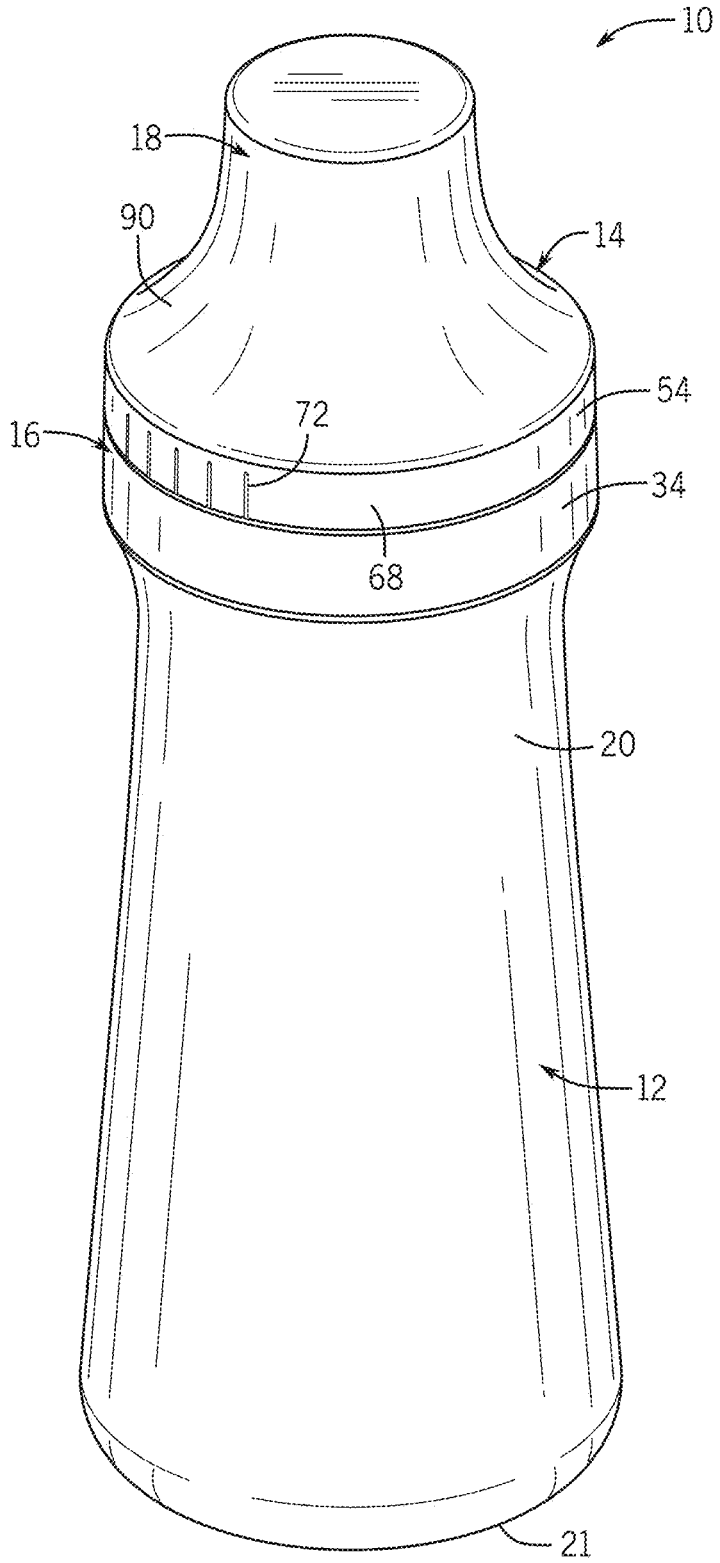
FIG. 1 shows a perspective view of an assembly for holding and dispensing a flowable consumer product according to the present disclosure.
Figure 2:
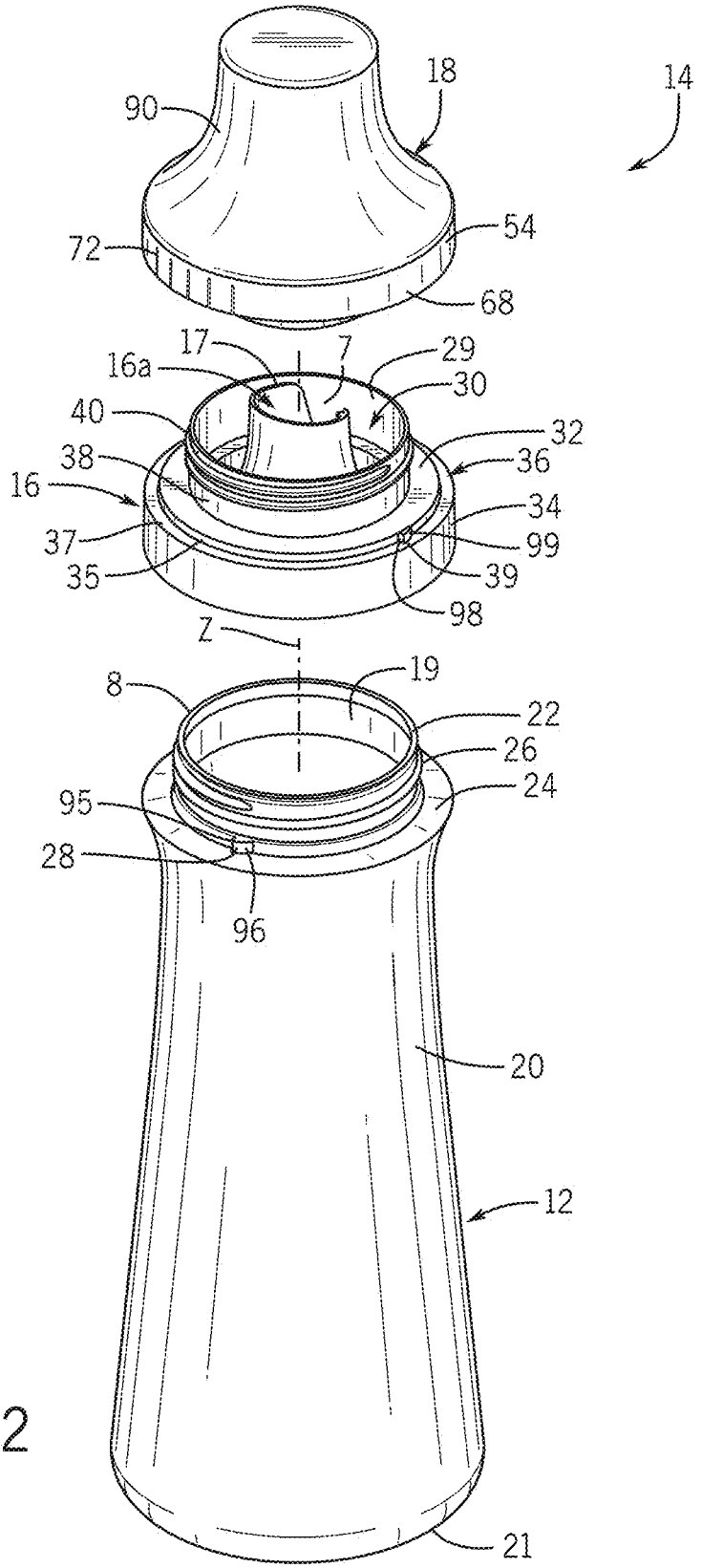
FIG. 2 shows an exploded view of the assembly of FIG. 1, including a bottle and a cover assembly.

FIGS. 1-2 show an assembly 10 for holding and dispensing a flowable consumer product. Non-limiting examples of the flowable consumer product include laundry detergent (liquid or particulate), fabric softener (liquid or particulate), laundry scent boosting compounds, dish detergent, cleansing spray, and/or the like. The assembly 10 includes a bottle 12 and a cover assembly 14. The cover assembly 14 is configured to be threadedly engaged with the bottle 12. The cover assembly 14 includes a spout 16 which is configured to be threadedly engaged with a cap 18, as shown in FIGS. 9-12.

Referring to FIG. 2, the bottle 12 includes a body 20 and a neck 22. The body 20 is a tapered cylinder, but may have other shapes (e.g., generally cylindrical, semi-conical, etc.). The body 20 has a closed bottom end 21 and extends upward toward an annular shoulder 24. The shoulder 24 extends axially inwardly toward the neck 22, such that the neck 22 is smaller in radius than the body 20. The neck 22 is also annular and has an inner face 19 and an outer face 8. The outer face 8 includes threads 26, which provide for threaded engagement with the spout 16, and a pair of diametrically opposed lugs 28, which are positioned in contact with the shoulder 24. The lugs 28 are shaped such that a perpendicular first face 95 of each lug 28 extends outward from the vertically oriented neck 22 at a right angle and a beveled or cammed second face 96 of each lug 28 extends from the vertically oriented neck 22 at an obtuse angle.

Figure 3:
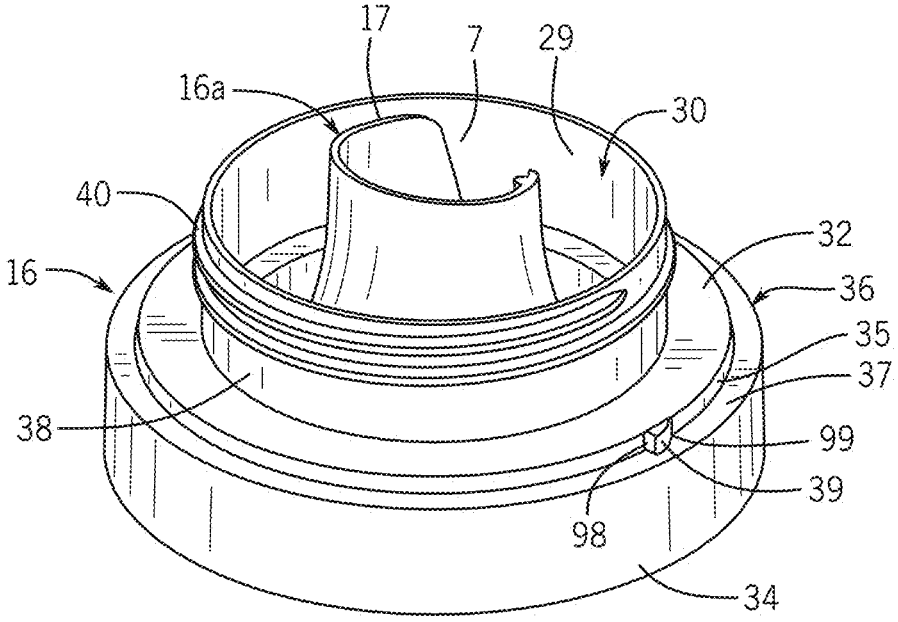
FIG. 3 shows a top perspective view of a spout of the cover assembly.
Figure 4:
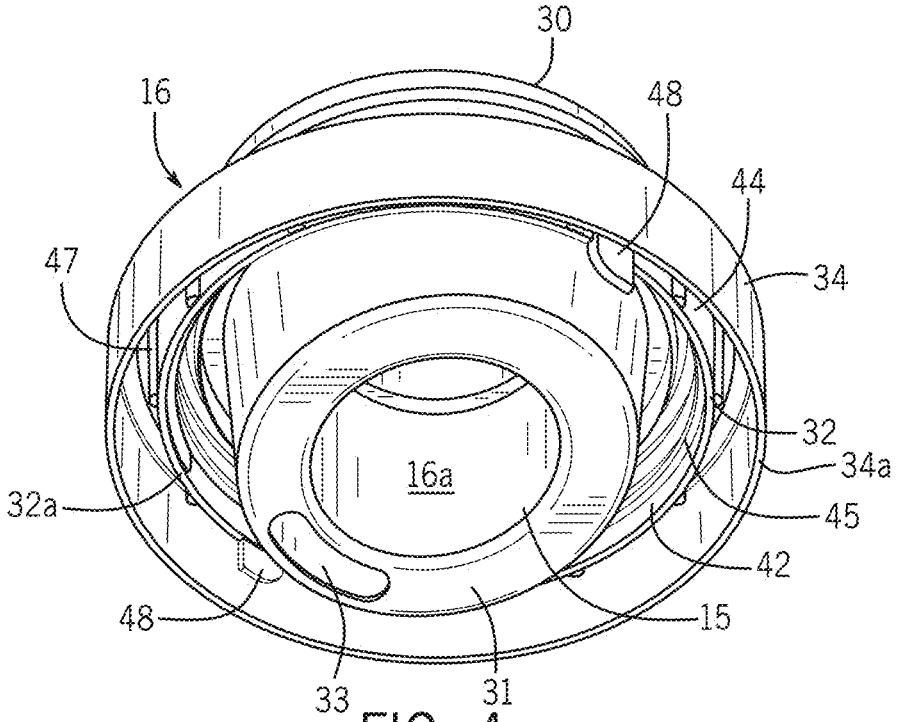
FIG. 4 shows a bottom perspective view of a spout of the cover assembly.
Figure 5:
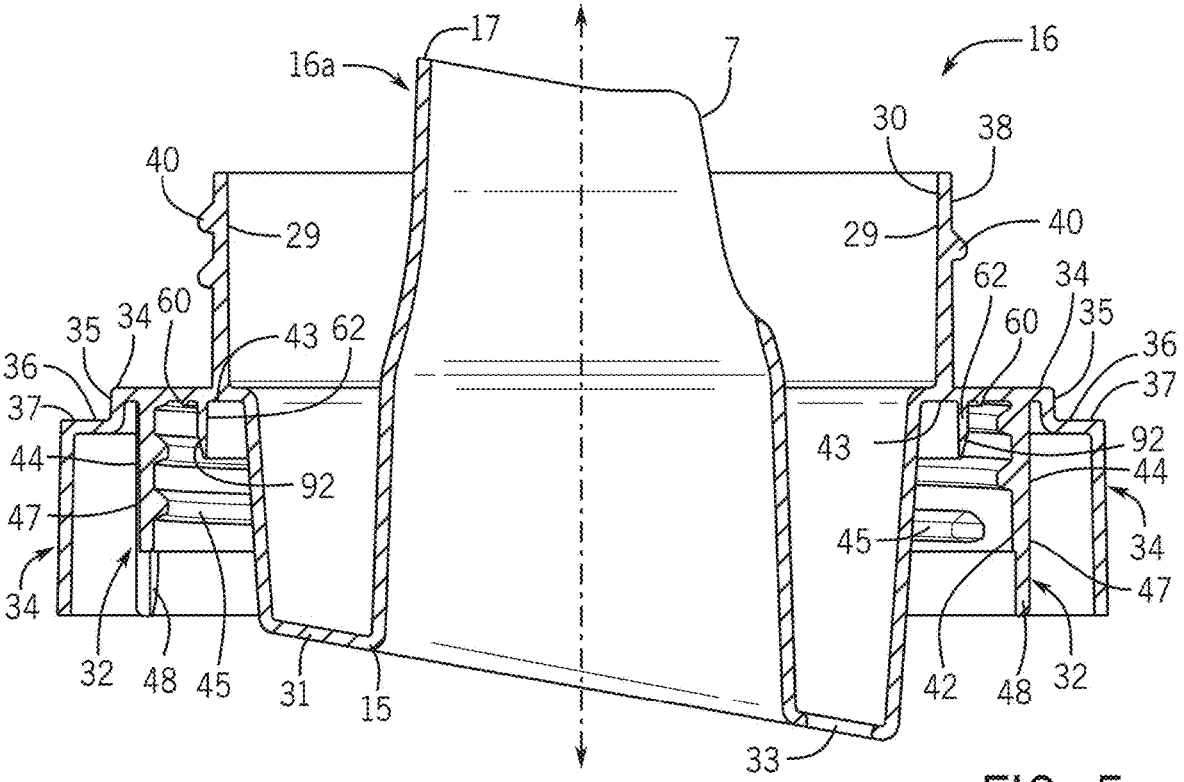
FIG. 5 shows a sectional view of the spout.
Figure 5A:
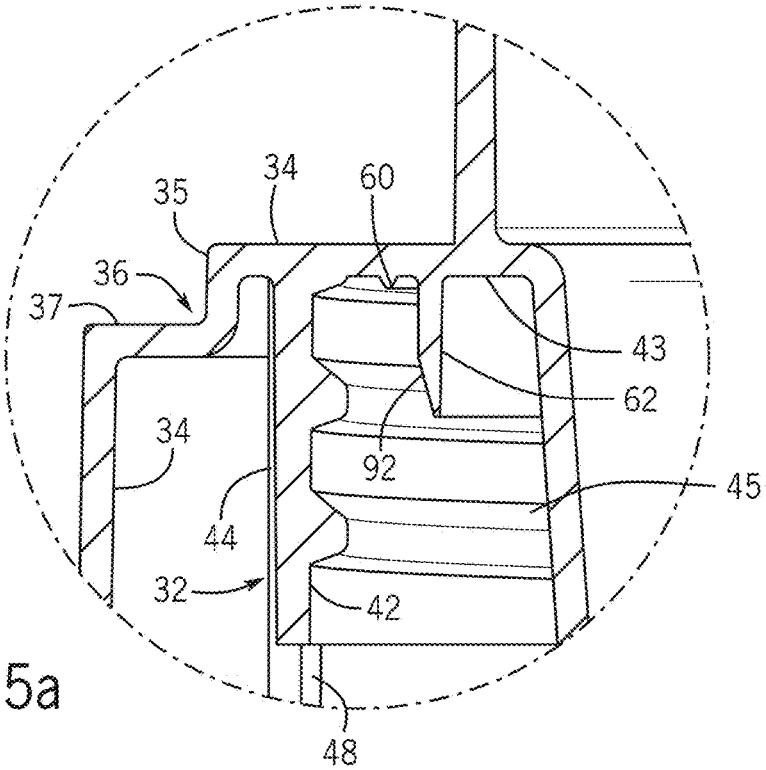
FIG. 5A shows an enlarged portion of FIG. 5.

Referring to FIGS. 3-5, the spout 16 includes a pour spout member 16*a*. The pour spout member 16*a* is semi-conical, extending upward from a funnel member 30 of the spout 16. First and second annular skirts 32, 34 are positioned radially outwardly of the funnel member 30. The first skirt 32 projects radially outwardly from the funnel member 30 and then axially downwardly and the second skirt 34 projects radially outwardly from the first skirt 32 and then axially downwardly, forming a stepped rim 36. The pour spout member 16*a*, the funnel member 30, and the first and second skirts 32, 34 all extend concentrically about a rotational axis Z.

As best shown in FIG. 5, the spout 16 has a bottom end 15 which is radially larger than a top end 17 thereof. The top end 17 has a cutout 7 and the bottom end 15 is formed by a bottom face 31 of the funnel member 30. The bottom face 31 of the funnel member 30 is angled downwardly toward a drain hole 33 such that excess liquid collecting in the funnel member 30 drains back into the bottle 12. The funnel member 30 extends vertically upward and circumferentially about the pour spout member 16*a*. The funnel member 30 has an inner face 29 and an outer face 38, the latter of which includes threads 40 for engagement with the cap 18.

Referring still to FIGS. 3-5, the first skirt 32 has a vertical inner face 42, an inner upper face 43, and a vertical outer face 44. The vertical inner face 42 includes threads 45 for engagement with the threads 26 of the bottle 12. The vertical outer face 44 includes vertical strengthening ribs 47 (FIG. 4) which are spaced evenly about the outer circumference of the first skirt 32. The first skirt 32 further includes diametrically opposed teeth 48 which extend vertically downward from a lower edge 32*a* of the first skirt 32 and are configured to engage with the lugs 28 of the bottle 12. As apparent from FIGS. 4, 10, and 11, the first and second skirts 32, 34 and the tooth 48 are dimensioned such that the tooth 48 does not extend below a lower edge 34*a* of the second skirt 34. This hides the functional tooth 48 from view when the spout 16 is attached to the bottle 12.

Figure 12:
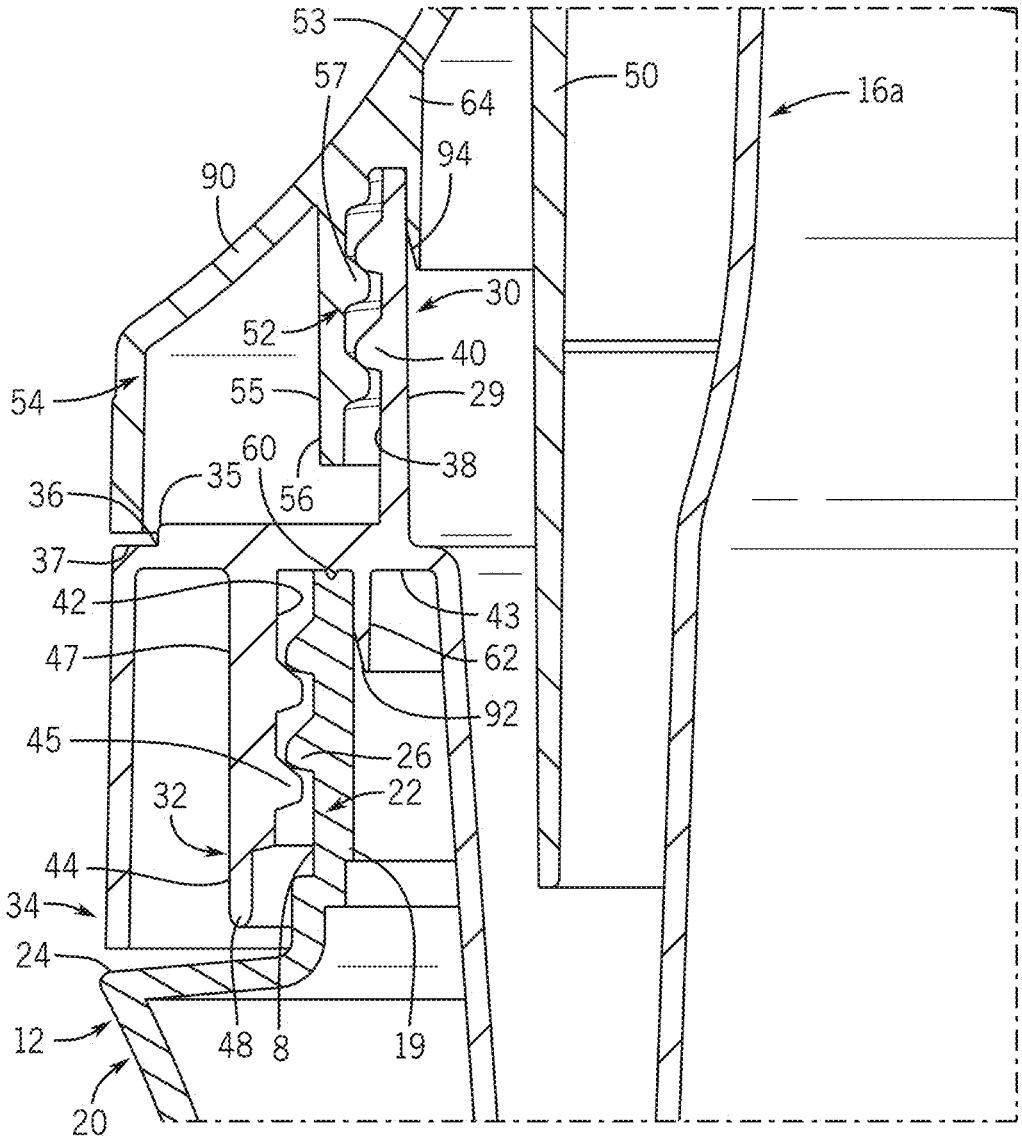
FIG. 12 shows a sectional view of a portion of the assembly for holding and dispensing a flowable consumer product.

As best shown in FIGS. 5 and 12, the first skirt 32 further includes a V-shaped seal 60 which protrudes downward from the inner upper face 43 and extends along the entirety of the first skirt 32. In the example shown herein, the V-shaped seal 60 is formed integrally (i.e., molded as part of) the spout 16 and may be made of the same material as the remainder of the spout 16. The first skirt 32 further includes an elongated plug seal 62 which protrudes downward from the inner upper face 43 and extends along the entirety of the first skirt 32. The plug seal 62 includes a beveled edge 92 which extends vertically downward and radially inward toward the rotational axis z. The plug seal 62 is adjacent to the V-shaped seal 60 and positioned radially inward with respect to the V-shaped seal 60 (i.e., toward the rotational z-axis) by a distance wide enough to accommodate the thickness of the neck 22 of the bottle 12. The second skirt 34 has an outer circumference which matches that of the cap 18 such that the spout 16 aligns flush with the cap 18, as shown in FIGS. 1 and 9-12, when the spout 16 and the cap 18 are assembled together to form the cover assembly 14.

As referenced above, the first skirt 32 and the second skirt 34 are connected via a stepped rim 36, which is best shown in FIGS. 3 and 5. The stepped rim 36 includes a vertical face 35 and a horizontal face 37. A pair of diametrically opposed lugs 39 (FIG. 3) are positioned on the vertical face 35 and extend radially outwards onto the stepped rim 36 for releasable engagement with the cap 18. The lugs 39 are shaped such that a perpendicular first face 98 extends outward from the vertical face 35 at a right angle and a beveled or cammed second face 99 extends from the vertical face 35 at an obtuse angle.

Figure 6:
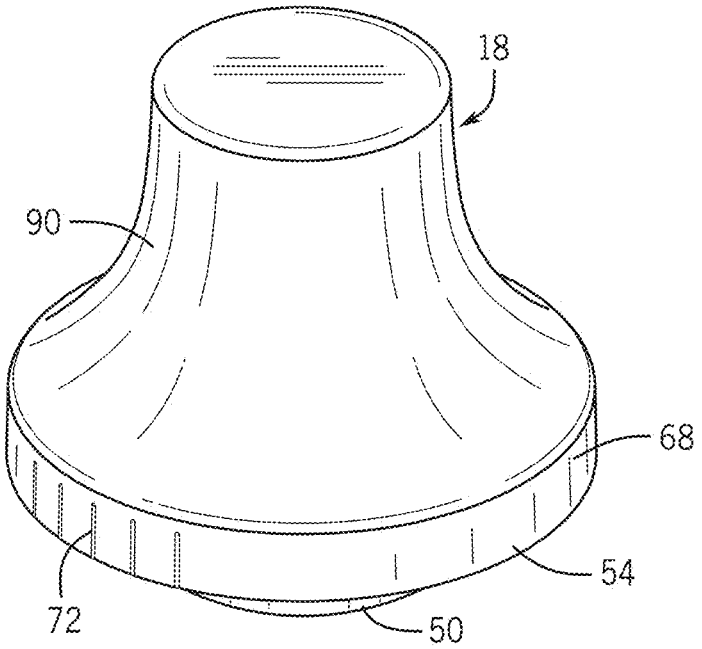
FIG. 6 shows a top perspective view of a cap of the cover assembly.
Figure 7:
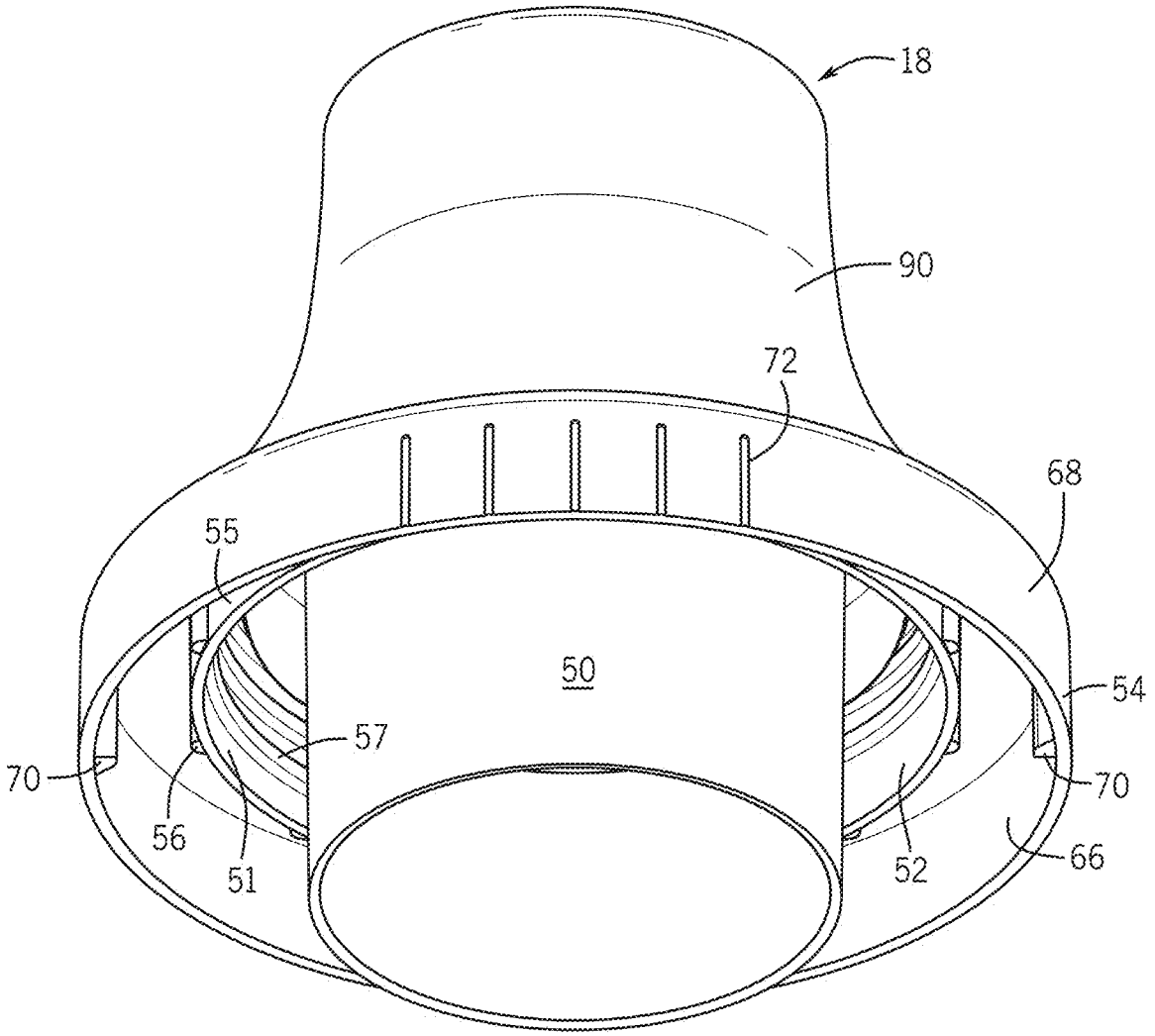
FIG. 7 shows a bottom perspective view of a cap of the cover assembly.
Figure 8:
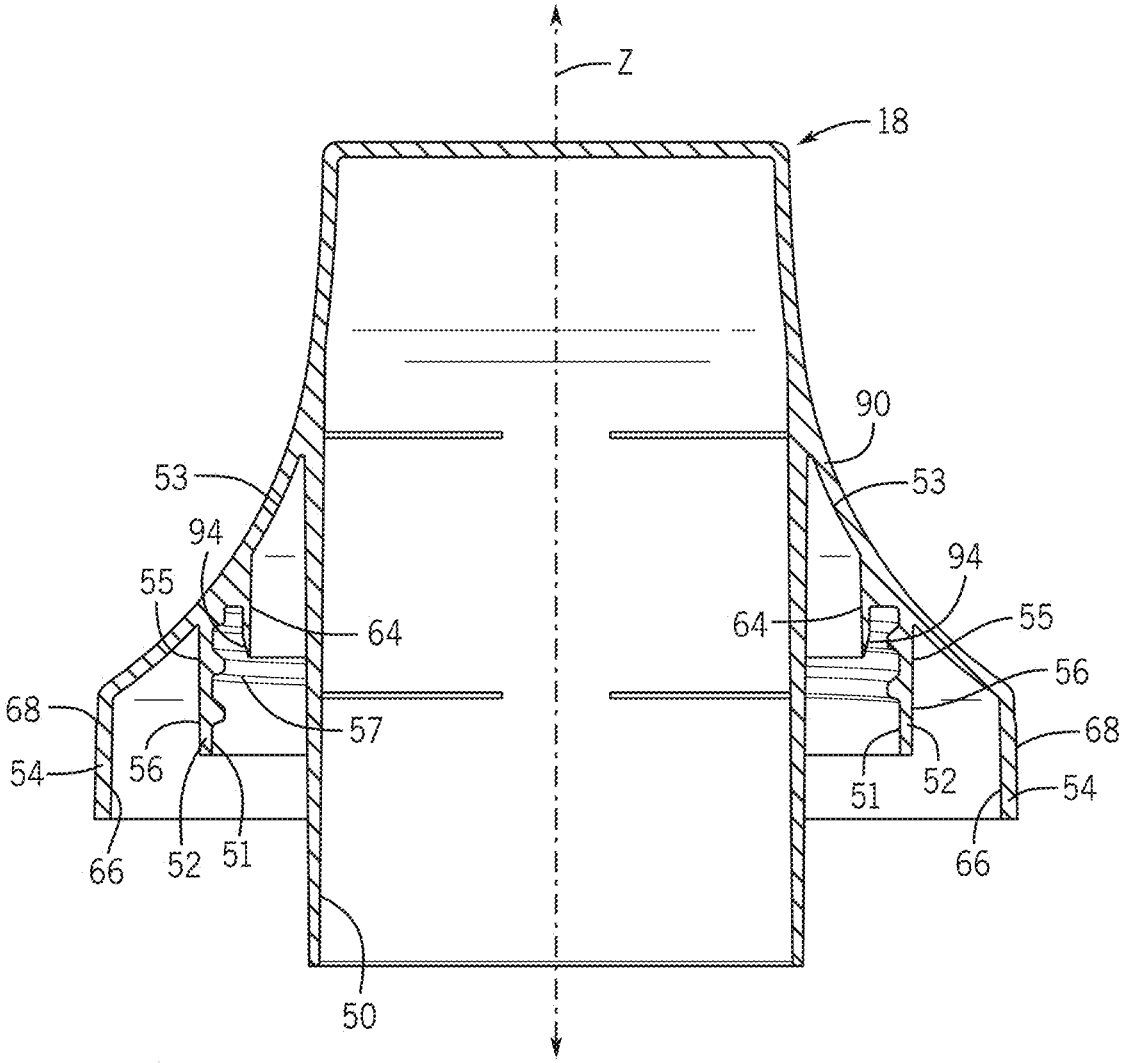
FIG. 8 shows a sectional view of the cap.
Figure 9:
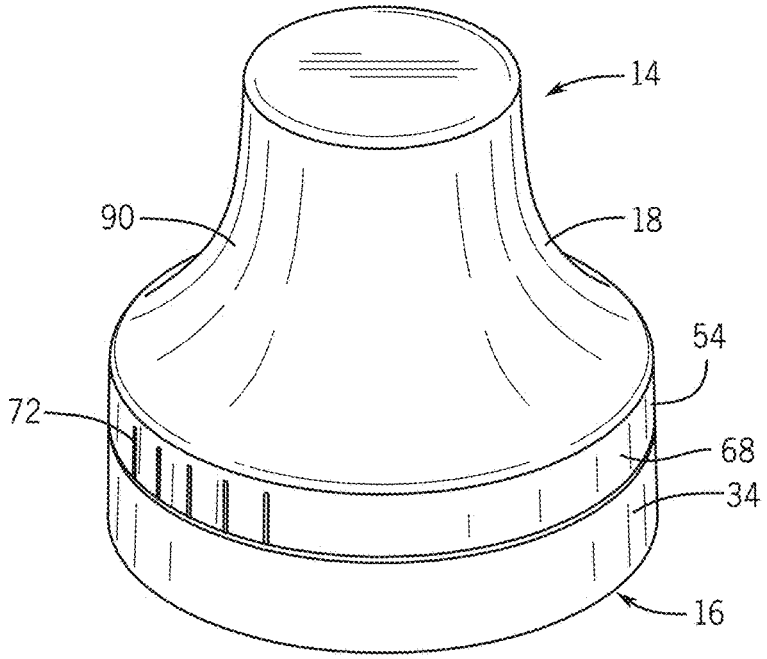
FIG. 9 shows a top perspective view of the cover assembly.
Figure 10:
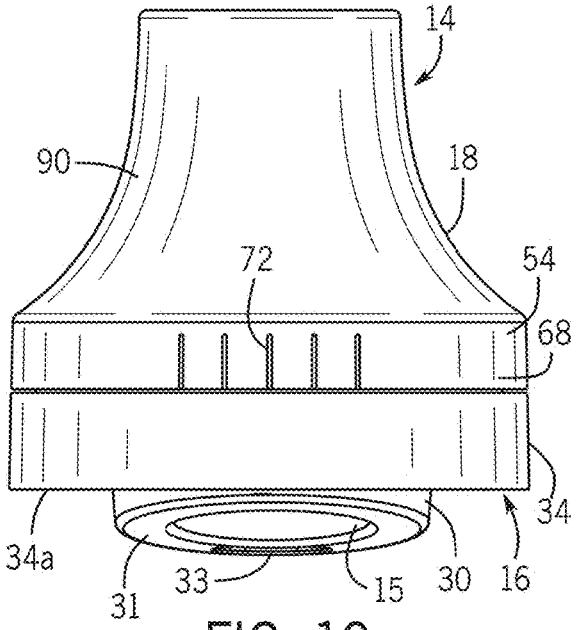
FIG. 10 shows a front elevation view of the cover assembly.
Figure 11:
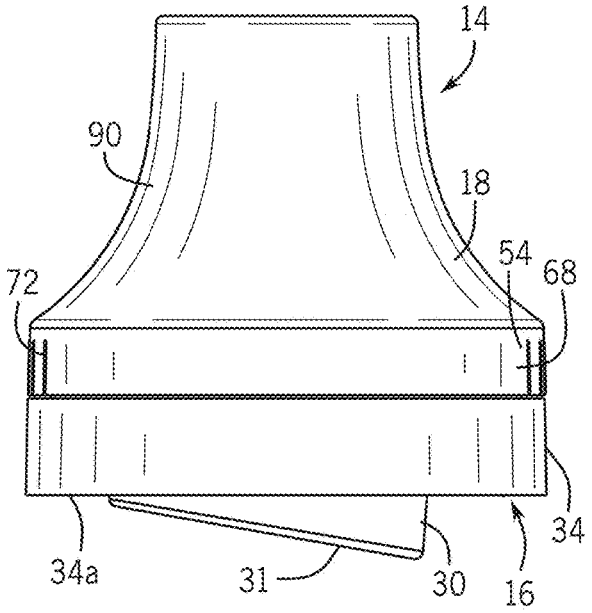
FIG. 11 shows a side elevation view of the cover assembly.

Referring to FIGS. 6-8, the cap 18 includes a central cylindrical body 50 and first and second skirts 52, 54 extending vertically and axially about the cylindrical body 50. The first skirt 52 and the second skirt 54 are connected via a curved upper surface 90 which extends vertically upward and axially inward until it is integral with the cylindrical body 50, providing a frustoconical shape to the cap 18. The first skirt 52 is positioned radially inward of the second skirt 54 with respect to the rotational axis z. The first skirt 52 has a vertical inner face 51, an inner upper surface 53, and an outer vertical surface 55. The vertical inner face 51 includes threads 57 for engagement with the threads 40 of the funnel member 30 on the spout 16. The inner upper surface 53 includes an elongated plug seal 64 which extends vertically downward and along the entirety of the first skirt 52. The plug seal 64 includes a beveled edge 94 which extends vertically downward and radially inward toward the rotational axis z. The outer vertical surface 55 of the first skirt 52 includes vertical strengthening ribs 56 (FIG. 7) which are spaced evenly about the outer circumference of the first skirt 52. The second skirt 54 has an inner face 66 and an outer face 68. As best shown in FIG. 7, the inner face 66 includes diametrically opposed vertically elongated lugs 70. The outer face 68 may include two sets of vertically extending serrations 72. The sets of vertical serrations 72 may be positioned on diametrically opposed sides of the cap 18 such that the sets of vertical serrations 72 are offset from the diametrically opposed lugs 70 by 90 degrees with respect to the rotational axis z. In other examples, no serrations are provided.

The present inventors recognized a need in the art for an assembly for holding and dispensing a flowable consumer product, which has improved sealing features such that leaking does not occur during the shipping process and excess plastic wrapping is not needed as a leak-preventative measure. The assembly 10 of the present disclosure provides an improved cover assembly 14 which restricts rotation of the spout 16 with respect to the bottle 12, such that removal of the spout 16 is not possible without deformation or breakage of the engagement means between the two. Further, the present disclosure provides dual sealing means between the spout 16 and the bottle 12 to further prevent leakage during the shipping process. The present disclosure also provides an improved cover assembly 14 in which the cap 18 is not likely to be twisted off the spout 16 unless a user applies sufficient torque, thereby lessening the chance the cap 18 accidentally will separate from the spout 16 during shipping.

Consistent with the foregoing, a preferred exemplary embodiment of the invention described herein comprises a bottle 12, 12' and a cover assembly 14 comprising a cap 18 and a spout 16, with at least one seal 60, 62 between the spout 16 and the bottle 12, 12', but does not include any additional plastic wrapping and/or covering applied to the assembly to assist in preventing leaks. In some of these preferred exemplary embodiments, the assembly may not have any additional plastic wrapping and/or covering applied to the assembly to assist in prevent leaks even though a plastic label, shrink wrap layer, etc. is applied to at least part of the bottle for marketing and/or cosmetic purpose(s).

Referring primarily to FIGS. 2 and 12, the spout 16 is engaged with the bottle 12 by aligning the spout 16 with the neck 22 of the bottle 12 and lowering and rotating the spout 16 about the z-axis in a first direction such that the threads 45 of the spout 16 engage with the threads 26 of the bottle 12. As the spout 16 is lowered and rotated, the V-shaped seal 60 and the plug seal 62 are brought into engagement with the neck 22 of the bottle 12. As shown in FIG. 12, the V-shaped seal 60 is brought into forceful engagement with an upper face/edge of the neck 22 such that the neck 22 deforms slightly to accommodate the V-shaped seal 60. Such deformation creates an extra seal aside from that provided by the plug seal 62. As the plug seal 62 is lowered, the beveled edge 92 guides the plug seal 62 into frictional engagement with the inner face 19 of the neck 22. The spout 16 is rotated until the second skirt 34 nears or comes into engagement with the shoulder 24 of the bottle 12. When nearing full engagement, the teeth 48 of the spout 16 and the lugs 28 of the bottle 12 are aligned circumferentially. The lugs 28 of the bottle 12 are formed such that rotation of the spout 16 in the first direction brings the teeth 48 of the spout 16 into sliding engagement with the beveled second face 96 of the lugs 28 such that rotation of the spout 16 with respect to the bottle 12 in the first direction (i.e., to attach the spout 16 to the bottle 12) is permitted. However, rotation of the spout 16 in a second direction opposite the first direction brings the teeth 48 into forceful engagement with the perpendicular first face 95 of the lugs 28 such that rotation of the spout 16 with respect to the bottle 12 in the second direction is restricted, insofar as rotation to overcome the restriction would result in deformation or breakage of the engaged lugs 28 and/or teeth 48. As such, once the spout 16 is fully assembled to the neck 22 of the bottle 12, removal of the spout 16 from the bottle 12 is thereafter prevented. Such an arrangement prevents accidental rotation of the spout 16 with respect to the bottle 12 in the second direction during shipping, thereby preventing leaks. There may be some "play" in that the spout 16 may rotate a half turn between engagement of the opposed lugs 28 and teeth 48. However, such play is not enough to disengage the seals 60, 62, and thus leakage is prevented. Play can be reduced, if desired, by the addition of more lugs on the lower edge 32*a* of the skirt 32 and/or on the shoulder 24 of the bottle 12.

The cap 18 is engaged with the spout 16 by aligning the cap 18 with the funnel member 30 and lowering and rotating the cap 18 about the rotational axis z in the first direction such that the threads 57 of the cap 18 engage with the threads 40 on the outer face 38 of the funnel member 30 of the spout 16. As the cap 18 is lowered and rotated, the plug seal 64 is brought into engagement with the funnel member 30. The plug seal 64 is lowered so that the beveled edge 94 guides the plug seal 64 into frictional engagement with the inner face 29 of the funnel member 30. The cap 18 is rotated in the first direction until the second skirt 54 engages with the horizontal face 37 of the stepped rim 36 on the spout 16. When nearing full engagement, the lugs 39 on the spout 16 and the elongated lugs 70 on the cap 18 are aligned circumferentially. The lugs 39 of the spout 16 are formed such that rotation of the cap 18 in the first direction brings the elongated lugs 70 into sliding engagement with the beveled second face 99 of the lugs 39 such that rotation of the cap 18 with respect to the spout 16 in the first direction is permitted. However, rotation of the cap 18 in the second direction brings the elongated lugs 70 into forceful engagement with the perpendicular first face 98 of the lugs 39 such that rotation of the cap 18 with respect to the spout 16 in the second direction is more difficult. To disengage the elongated lugs 70 from the lugs 39, a user must apply a torque to the cap 18 in the second direction that is greater than a threshold torque. The threshold torque may be one that an able-bodied adult user is relatively easily able to apply, but one that a child is not relatively easily able to apply. Further, the threshold torque is greater than any incidental torque that may be applied to the cap 18 during shipping. Rotating the cap 18 in the second direction will engage the threads 40 with the threads 57 to move the cap 18 upwardly with respect to the spout 16. Once engagement of the threads 40 with the threads 57 moves the cap 18 upwardly enough that the elongated lugs 70 vertically clear the lugs 39, the user will not need to apply as much torque and may continue rotation of the cap 18 in the second direction with a lesser applied torque until the cap 18 is released from the spout 16. The arrangement of the lugs 39 and the elongated lugs 70 prevents the cap 18 from accidentally disengaging from the spout 16 during shipping, thereby preventing leakage, as well as child-proofs the assembly. However, a user is still able to remove the cap 18 from the spout 16 by applying torque above the threshold and rotating the cap 18 in the second direction, as described.

In another example in which serrations 72 are provided on the cap 18, the user may press forcefully inward on the cap 18 at the locations of the vertical serrations 72. Upon doing so, the cap 18 will deform, bowing radially outward where the elongated lugs 70 are positioned, thus disengaging the elongated lugs 70 from the lugs 39. Once disengaged, the user must continue to press forcefully inward on the cap 18 at the locations of the vertical serrations 72 while rotating the cap 18 in the second direction, engaging the threads 40 with the threads 57 to move the cap 18 upwardly with respect to the spout 16 as rotation in the second direction continues. Once engagement of the threads 40 with the threads 57 moves the cap 18 upwardly enough that the elongated lugs 70 vertically clear the lugs 39, the user may release force on the vertical serrations 72 and continue rotation of the cap 18 in the second direction until the cap 18 is released from the spout 16.

Figure 13:
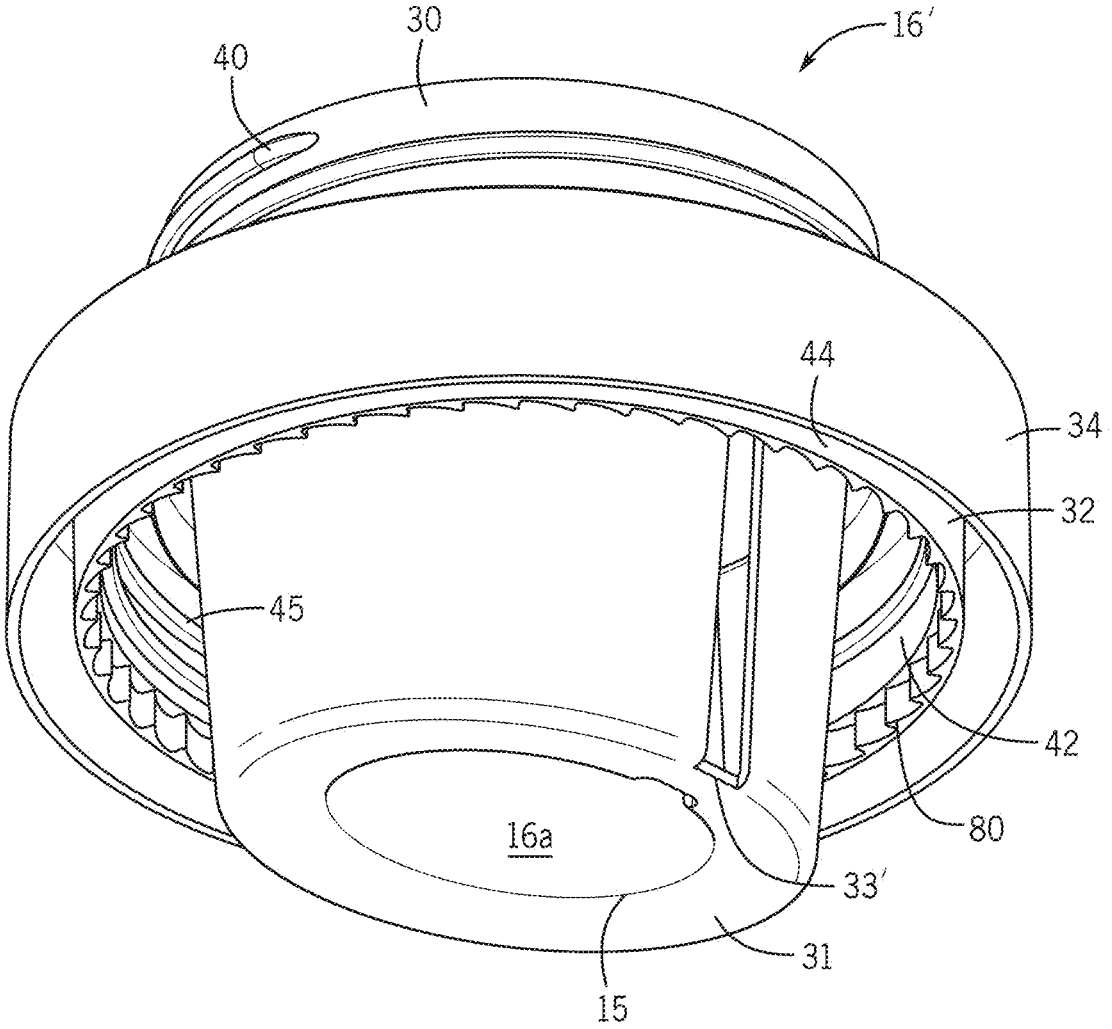
FIG. 13 shows a bottom perspective view of an alternate spout of the cover assembly.

FIG. 13 shows an alternative spout 16' of the cover assembly 14. The spout 16' is formed similarly to the spout 16, and includes the funnel member 30, the first skirt 32, and the second skirt 34. The funnel member 30 includes an alternatively shaped drain 33', which extends upward within the pour spout member 16*a*. The first skirt 32 includes the inner face 42 and the outer face 44. The inner face 42 includes the threads 45 for engagement with the threads 26 of the bottle 12. In this alternative embodiment, the first skirt 32 includes ratchet teeth 80 about the entire inner circumference of the first skirt 32, which ratchet teeth 80 are sloped radially inward in a direction opposite the winding of the threads 45. As such, when the spout 16' is engaged with the bottle 12, rotation of the spout 16' in a first direction with respect to the bottle 12 is permitted, as the ratchet teeth 80 slidingly engage with the lugs 28 on the bottle 12. However, rotation of the spout 16' with respect to the bottle 12 in a second direction opposite the first direction is restricted as the ratchet teeth 80 come into forceful engagement with the lugs 28 of the bottle. As such, removal of the spout 16' from the bottle 12 is restricted insofar as forceful removal of the spout 16' from the bottle 12 would result in deformation or breakage of the lugs 28 and/or ratchet teeth 80. Such an arrangement of the lugs 28 and ratchet teeth 80 prevents inadvertent removal of the spout 16' from the bottle 12 during shipping, thereby preventing leaks.

Figure 14:
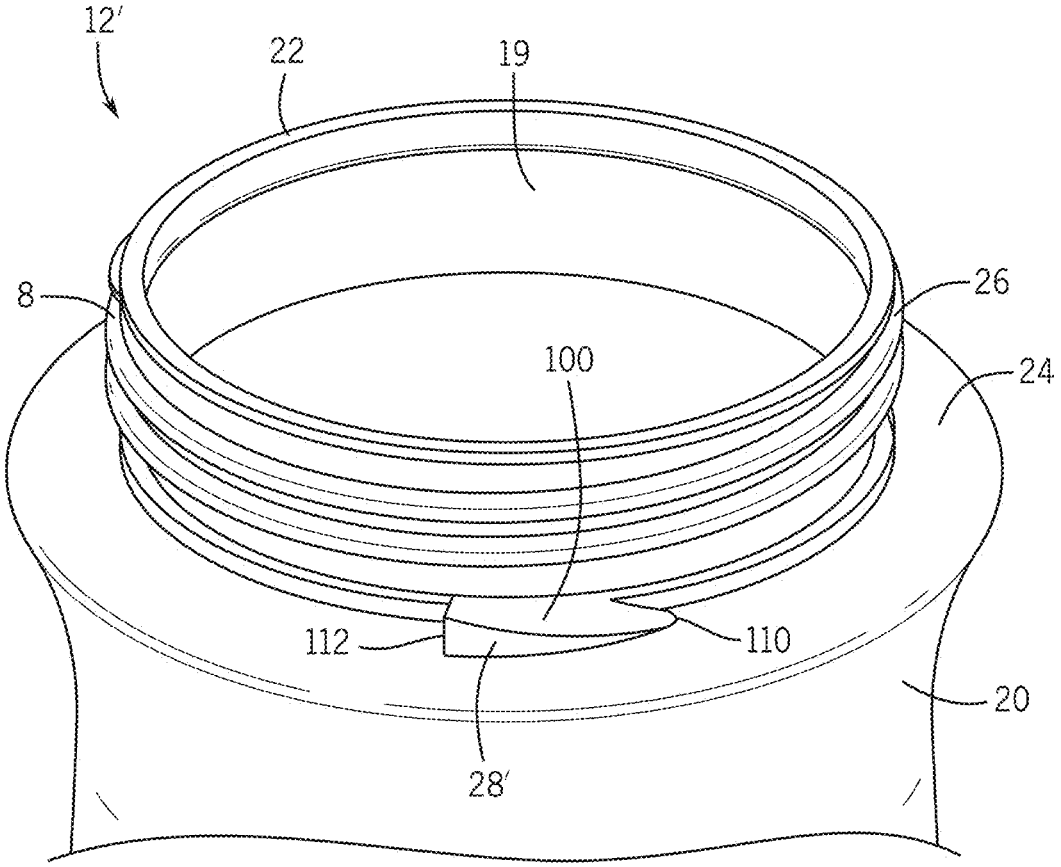
FIG. 14 shows the shoulder area of another embodiment of a bottle according to the present disclosure.

FIG. 14 shows the shoulder area of another embodiment of a bottle 12' according to the present disclosure. The bottle 12' includes a body 20 and a neck 22, which has an inner face 19 and an outer face 8 with threads 26. A shoulder 24 surrounds the neck 22. The only difference between the bottle 12' of FIG. 14 and the bottle 12 of FIG. 2 is in the design of the lug 28' on the shoulder 24. The lug 28' has a lower first end 110 that slopes upwardly toward a higher second end 112. The lower first end 110 is connected to the higher second end 112 by an angled ramp 100. The tooth 48 on the lower edge 32*a* of the first skirt 32 on the spout 16 is configured to ride over the lug 28' from the first end 110 to the second end 112 thereof (such as by sliding over angled ramp 100) as the spout 16 is threaded onto the bottle 12' in the first direction. However, rotation of the spout 16 relative to the bottle 12' in the second direction is prevented by way of the tooth 48 engaging with the higher second end 112 of the lug 28', past which the tooth 48 is not able to rotate without permanently deforming or breaking the tooth 48 and/or the lug 28'. The shape of the lug 28' may provide efficiencies as far as assembly of the spout 16 to the bottle 12' is concerned, as it may be more efficient for a machine to rotate the tooth 48 over the angled ramp 100 of the lug 28' than over lugs with different shapes.

Figure 15:
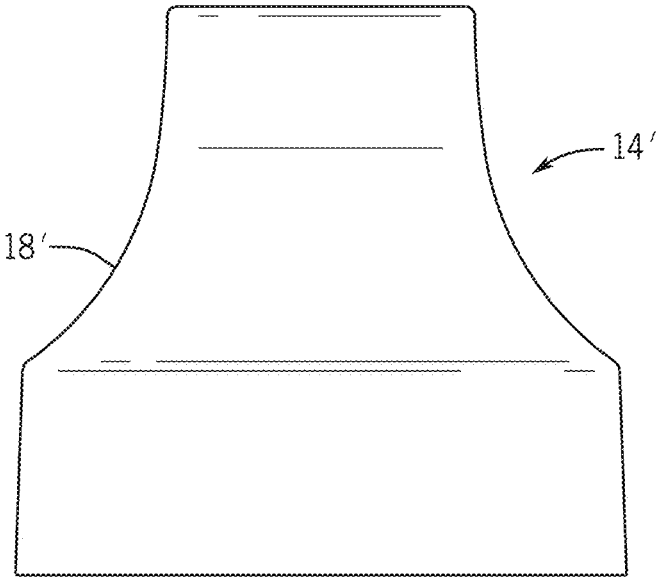
FIG. 15 shows another embodiment of a cap according to the present disclosure.
Figure 16:
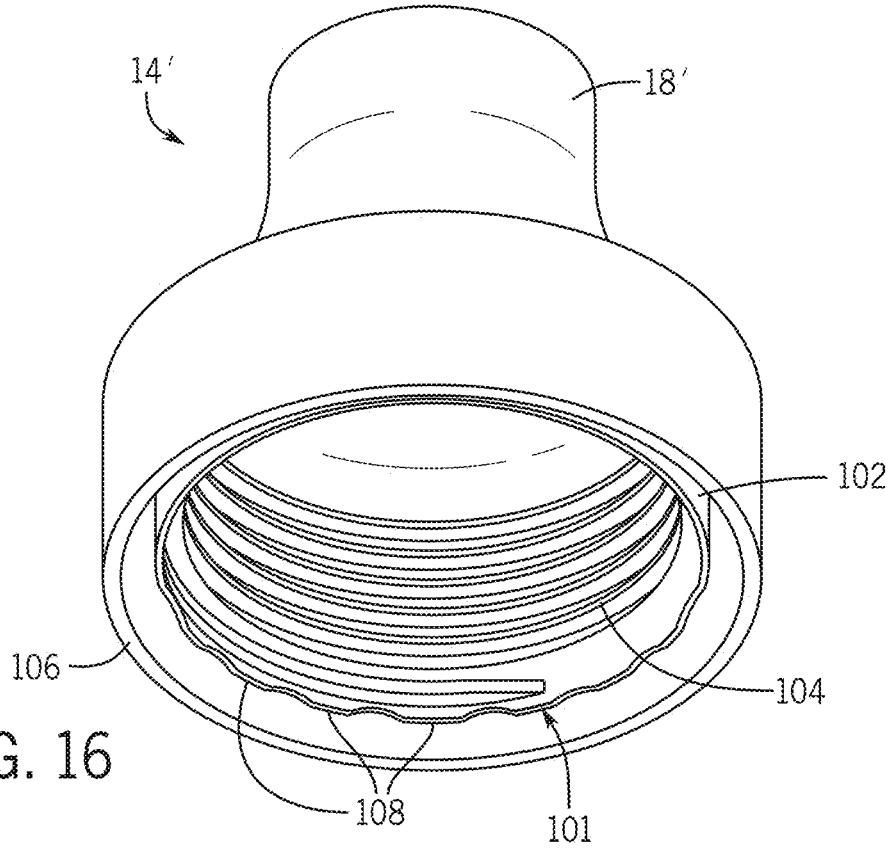
FIG. 16 shows a bottom perspective view of the cap of FIG. 15.

FIGS. 15 and 16 show another example of a cover assembly 14' according to the present disclosure. In this example, the cover assembly 14' comprises a cap 18' only. From the outside, the cap 18' has the visual shape of the cap 18 and the spout 16 of FIGS. 9-11 combined into one part. From the inside, as shown in FIG. 16, the cap 18' has an annular sleeve 102 having threads 104 configured to threadedly engage with the threads 26 on the bottle 12. For purposes of brevity, only the bottle 12 of FIG. 2 will be referred to herein, although it should be understood that the cap 18' could be threadedly engaged with the threads 26 of the bottle 12' of FIG. 14 as well. The cap 18' comprises an annular outer skirt 106 circumferentially surrounding the sleeve 102. The lower edge 101 of the sleeve 102 comprises one or more undulations 108 (i.e., wave-like projections) that are configured to interact with the lug 28 on the bottle 12 so as to provide haptic feedback to a user indicating that the cap 18' is nearly fully threaded onto the bottle 12. This way, over-tightening of the cap 18' onto the bottle 12 can be prevented, as the user will feel the undulations 108 passing over the lug 28 and know that the cap 18' is nearing full engagement. As such, the undulations 108 are sized such that the undulations 108 contact the lug 28 only when the cap 18' is nearly fully threaded onto the bottle 12.

Figure 17:
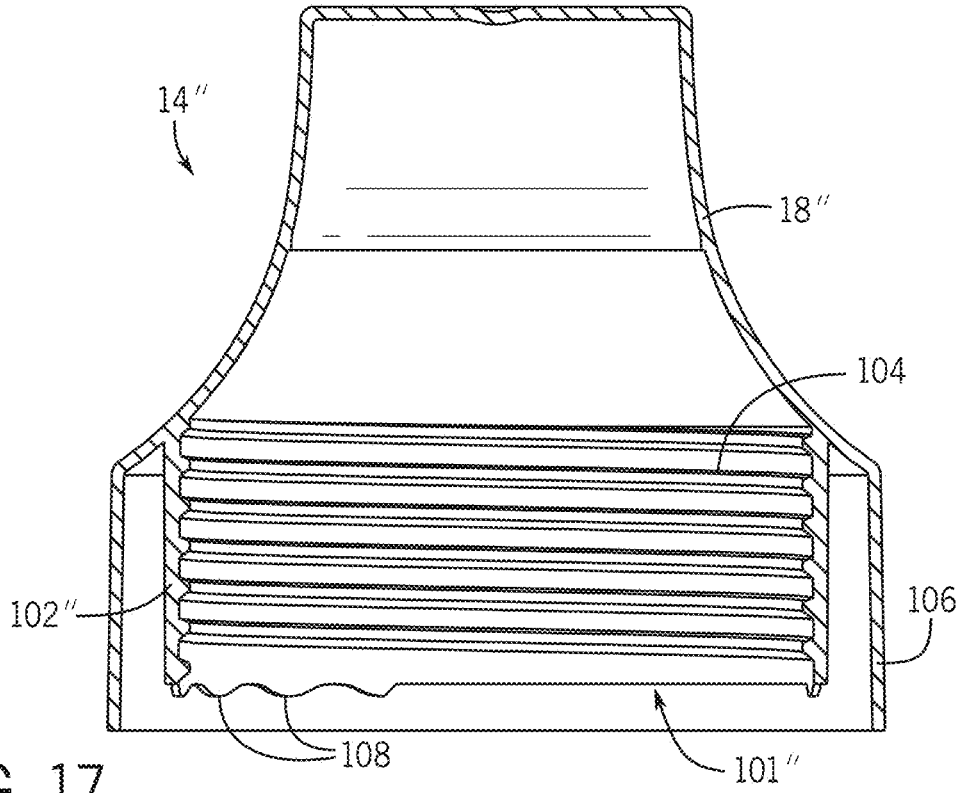
FIG. 17 shows a cross section of a cap like that of FIG. 15.
Figure 18:
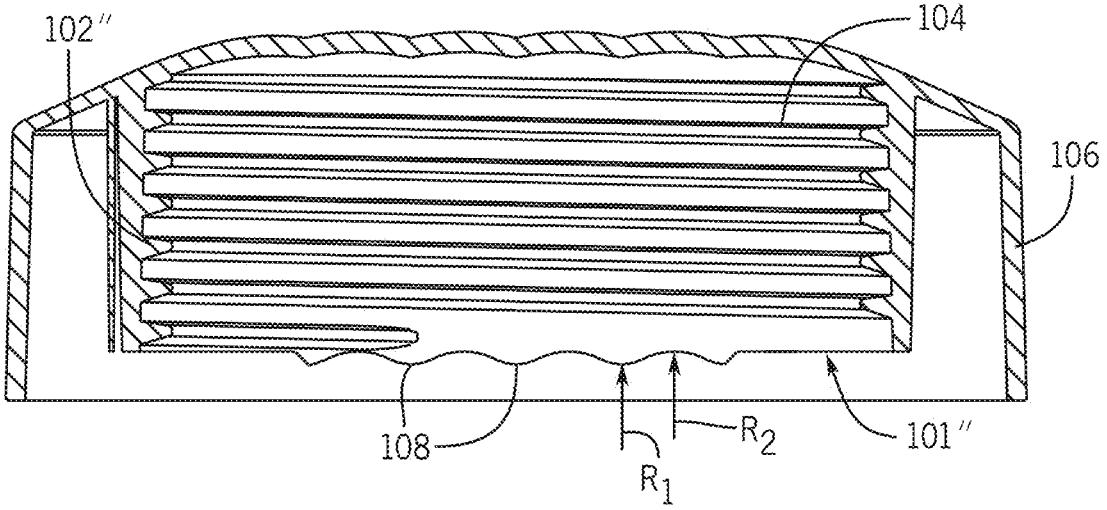
FIG. 18 is a detailed view of a portion of the cap of FIG. 17.

In the example of FIG. 16, the undulations 108 extend along an entirety of the lower edge 101 of the sleeve 102. In contrast, in the cover assembly 14" shown in FIGS. 17 and 18, the undulations 108 extend along only a portion or portions of the lower edge 101" of the sleeve 102". (Note that the cap 18" of FIGS. 17 and 18 is outwardly visually the same as the cap 18' shown in FIG. 15.) The undulations 108 are provided only at a location where the threads 104 on the sleeve 102" and the threads 26 on the neck 22 of the bottle 12 dictate that the undulations 108 will interact with the lug 28 as the cap 18" is nearly fully tightened onto the neck 22 of the bottle 12. FIG. 17 shows the cap 18" in cross section from a first direction, while FIG. 18 shows the cap 18" in cross section from a second direction perpendicular to the first direction. As shown in FIG. 18, the undulations 108 may be rather shallow, and may have a convex radius $R_1$ of about 5 mm and a concave radius $R_2$ of about 5.32 mm. The undulations 108 are not intended to require that significantly increased torque be applied to move the undulations 108 over the lugs 28; rather, they are intended to provide "bumpy" feedback to the user to let the user know the cap 18" is tight enough. For purposes of brevity, only the bottle 12 of FIG. 2 is referred to herein, although it should be understood that the cap 18" could be threadedly engaged with the threads 26 of the bottle 12' of FIG. 14 as well.

Figure 19:
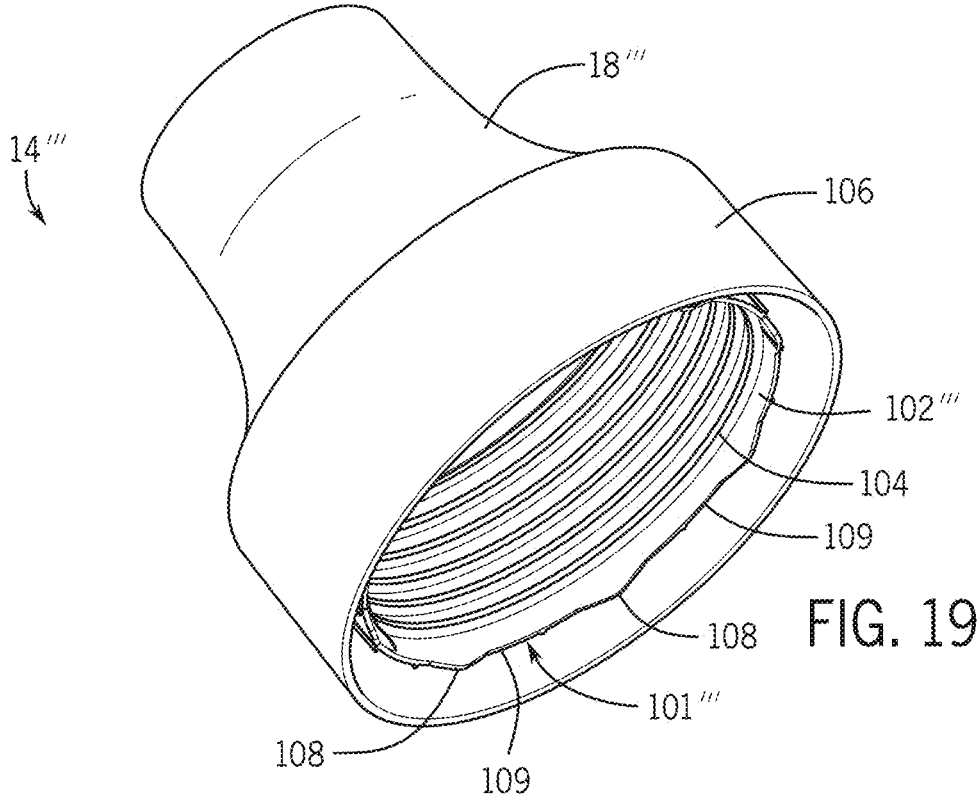
FIG. 19 shows a bottom perspective view of another embodiment of a cap according to the present disclosure.
Figure 20:
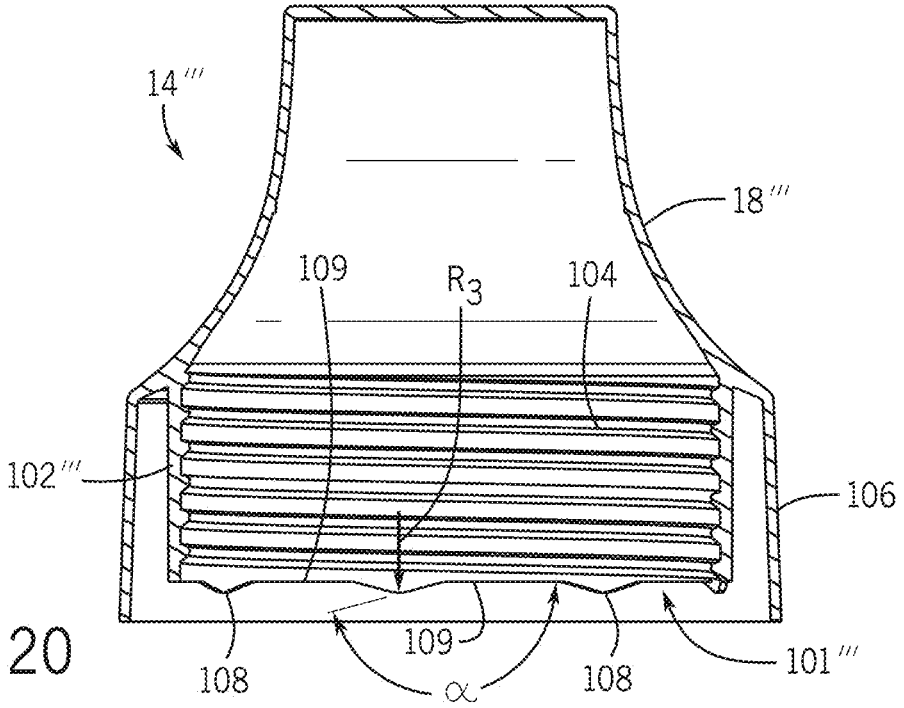
FIG. 20 shows a cross section of the cap of FIG. 19.

FIG. 19 shows a bottom perspective view of yet another example of a cover assembly 14''' comprising only a cap 18''' according to the present disclosure, while FIG. 20 is a cross-sectional view thereof. It can be seen that the cap 18''' has an inner sleeve 102''' with threads 104 for connecting the cap 18''' to the threads 26 on the bottle 12. An outer skirt 106 circumferentially surrounds the inner sleeve 102'''. As with the caps 18', 18" of FIGS. 15-18, the lower edge 101''' of the cap 18 comprises undulations 108. However, in this example, the undulations 108 are each separated by a flat section 109 of the lower edge 101'''. The undulations 108 provide haptic feedback to a user when the undulations 108 come into contact with the lug 28 on the bottle 12, letting the user know that the cap 18''' is almost fully threaded onto the bottle neck 22, which in turn prevents overtightening of the cap 18''' onto the neck 22. The flat sections 109 allow the cap 18''' to be twisted in the first or second direction on the neck 22 along the length of the flat section 109 without requiring increased torque to be applied to cause the undulation 108 to move over the lug 28. The undulations 108 also serve as locking features, which prevent the cap 18''' from inadvertently being loosened during shipping. When an undulation 108 contacts the perpendicular first face 95 of the lug 28, a torque above that which could reasonably be applied during shipping is required to move the undulation 108 past the lug 28. For purposes of brevity, only the bottle 12 of FIG. 2 is referred to herein, although it should be understood that the cap 18''' could be threadedly engaged with the threads 26 of the bottle 12' of FIG. 14 as well, in which case locking is provided when an undulation 108 contacts the higher second end 112 of the lug 28'.

In non-limiting examples, the undulations 108 may have a radius $R_3$ of about 5 mm. The sloped side of a given undulation 108 may be oriented at an angle $\alpha$ with respect to the adjacent flat portion 109, where $\alpha$ is between 160-170 degrees. In a particularly preferred embodiment, $\alpha$ is 165 degrees.

The bottle 12, 12', spout 16, 16', and cap 18, 18', 18", 18''' can be made of any appropriate polymer, with high-density polyethylene being preferred. If all components are made of the same polymer ("mono resin"), they can all be recycled while assembled together. The bottle 12, 12' may, for example, be blow molded, while the cap 18, 18', 18", 18''' and spout 16, 16' may, for example, be injection molded. A V-shaped seal is not provided at the interface between the spout 16, 16' and the cap 18 because these parts are injection molded and have tighter tolerances than the blow-molded bottle 12, 12'. However, a V-seal could be provided on the downwardly facing surface of the first skirt 52 of the cap 18, between the plug seal 64 and the inner face 51 thereof, for engagement with the upwardly facing surface at the top of the funnel member 30 of the spout 16. In a preferred exemplary embodiment, the bottle 12, 12', spout 16, 16', and cap 18, 18', 18", 18''' are all made of high-density polyethylene. In another preferred exemplary embodiment, the bottle 12 and spout 16 are made of high-density polyethylene while the cap 18 is made from a different material. In another preferred exemplary embodiment, the bottle, spout, and/or cap may be made using post-consumer recycled ("PCR") plastic. Some preferred exemplary embodiments comprise at least one component, such as the bottle, made entirely of PCR plastic. Some preferred exemplary embodiments comprise at least one component, such as the bottle, made of between about 70%-100% PCR, preferably of about 80-100% PCR, and even more preferably of 85%-100% PCR.

In the above description, certain terms have been used for brevity, clarity, and understanding. No unnecessary limitations are to be inferred therefrom beyond the requirement of the prior art because such terms are used for descriptive purposes and are intended to be broadly construed. The order of method steps or decisions shown in the Figures and described herein are not limiting on the appended claims unless logic would dictate otherwise. It should be understood that the decisions and steps can be undertaken in any logical order and/or simultaneously. The different systems and methods described herein may be used alone or in combination with other systems and methods. It is to be expected that various equivalents, alternatives and modifications are possible within the scope of the appended claims.

What is claimed is:

1. An assembly for holding and dispensing a flowable consumer product, the assembly comprising:

a bottle; and a cover assembly including:

a spout which is configured to threadedly engage with the bottle; and a cap which is configured to threadedly engage with the spout;

wherein the bottle and the cover assembly are configured to be threadedly engaged in a manner such that rotation of the cover assembly with respect to the bottle is permitted in a first direction and restricted in an opposite, second direction;

wherein the bottle includes a lug and the spout includes a tooth, and wherein the lug and the tooth are configured to be engaged to prevent rotation of the spout relative to the bottle in the second direction;

wherein the spout includes a first skirt and a second skirt surrounding the first skirt, and the tooth extends downwardly from a lower edge of the first skirt;

wherein the cover assembly includes a first seal that is configured to engage with an inner surface of the bottle; and wherein the cover assembly includes a second seal having a downward projection that is configured to engage with an upper surface of the bottle.

2. The assembly of claim 1, wherein the spout is configured to be threadedly engaged with the bottle in a manner such that rotation of the spout with respect to the bottle is permitted in the first direction and restricted in the opposite, second direction.

3. The assembly of claim 1, wherein the lug has a lower first end that slopes upwardly toward a higher second end, and wherein the tooth is configured to ride over the lug from the first end to the second end thereof as the spout is threaded onto the bottle in the first direction.

4. The assembly of claim 1, wherein the lug has a lower first end that slopes upwardly toward a higher second end, and wherein rotation of the spout relative to the bottle in the second direction is prevented by way of the tooth engaging with the second end of the lug.

5. The assembly of claim 1, wherein the first and second skirts and the tooth are dimensioned such that the tooth does not extend below a lower edge of the second skirt.

6. The assembly of claim 1, wherein the first seal is a plug seal, the second seal is a V-shaped seal, and the first seal is positioned adjacent to the second seal.

7. The assembly of claim 6, wherein the first seal is located radially inwardly of the second seal.

8. The assembly of claim 1, wherein the first seal is a plug seal.

9. The assembly of claim 1, wherein the second seal is a V-shaped seal.

10. An assembly for holding and dispensing a flowable consumer product, the assembly comprising:

a bottle having a neck;

a spout configured to be attached to the neck; and a cap configured to be attached over a dispensing end of the spout;

wherein the spout includes a plug seal and a V-shaped seal that are configured to be engaged with the neck of the bottle;

wherein the spout is configured to be threadedly engaged with the neck in a manner such that rotation of the spout with respect to the bottle is permitted in a first direction and restricted in an opposite, second direction;

wherein the cap is configured to be threadedly engaged with the spout;

wherein the bottle includes a lug and the spout includes a tooth, and wherein the lug and the tooth are configured to be engaged to prevent rotation of the spout relative to the bottle in the second direction;

wherein the spout includes a first skirt and a second skirt surrounding the first skirt;

wherein the tooth extends downwardly from a lower edge of the first skirt; and wherein the first and second skirts and the tooth are dimensioned such that the tooth does not extend below a lower edge of the second skirt.

11. The assembly of claim 10, wherein the V-shaped seal is a downward projection that extends from a lower inner surface of the spout and frictionally engages with an upper surface of the neck of the bottle.

12. The assembly of claim 10, wherein the plug seal is a downwardly elongated protrusion having an outer surface that is configured to frictionally engage an inner surface of the neck of the bottle.

13. The assembly of claim 12, wherein the plug seal includes a beveled end that is configured to engage the neck of the bottle and guide the plug seal into frictional engagement with the bottle.

14. The assembly of claim 10, wherein the lug has a lower first end that slopes upwardly toward a higher second end, and wherein the tooth is configured to ride over the lug from the first end to the second end thereof as the spout is threaded onto the bottle in the first direction.

15. The assembly of claim 10, wherein the lug has a lower first end that slopes upwardly toward a higher second end, and wherein rotation of the spout relative to the bottle in the second direction is prevented by way of the tooth engaging with the second end of the lug.

* * * * *